US010495998B2

(12) United States Patent
Sun et al.

(10) Patent No.: US 10,495,998 B2
(45) **Date of Patent: *Dec. 3, 2019**

(54) MULTILAYERED TONER PARTICLE HAVING A BORAX COUPLING AGENT AND METHOD OF PREPARING THE SAME

(71) Applicant: LEXMARK INTERNATIONAL, INC., Lexington, KY (US)

(72) Inventors: Jing X Sun, Lexington, KY (US); Corey Marcus Moran, Louisville, KY (US); Cory Nathan Hammond, Winchester, KY (US); Aaron Michael Dahlke, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/211,512

(22) Filed: Dec. 6, 2018

(65) Prior Publication Data

US 2019/0302634 A1 Oct. 3, 2019

Related U.S. Application Data

(63) Continuation of application No. 15/941,203, filed on Mar. 30, 2018, now Pat. No. 10,180,634.

(51) Int. Cl.

| | |
|---|---|
| ***G03G 9/087*** | (2006.01) |
| ***G03G 9/093*** | (2006.01) |
| ***G03G 9/08*** | (2006.01) |

(52) U.S. Cl.

CPC ..... *G03G 9/09371* (2013.01); *G03G 9/0819* (2013.01); *G03G 9/08755* (2013.01); *G03G 9/09328* (2013.01)

(58) Field of Classification Search

CPC ..... G03G 9/09371; G03G 9/0819; G03G 9/08755; G03G 9/09328

See application file for complete search history.

(56) References Cited

U.S. PATENT DOCUMENTS

2019/0302635 A1* 10/2019 Sun ..... G03G 9/09392

* cited by examiner

*Primary Examiner* — Peter L Vajda

(57) ABSTRACT

A chemically prepared multilayered toner composition, according to one example embodiment, includes a core having a first amorphous polyester resin, a second amorphous polyester resin, a colorant, and a release agent. A first layer is formed around the core wherein the first layer includes the same second amorphous polyester resin that is in the toner core. A second layer is formed on the surface of the first layer, wherein the second layer includes a third amorphous polyester resin. A borax coupling agent is between the first and second layers. In an embodiment the ratio of the second polymer in the core to second polymer in the first layer is about 50:50. The second layer can also be referred to as a shell that is formed over the toner particle having a center core, first layer and borax coupling agent. In another embodiment, the core does not contain a second amorphous polyester resin.

4 Claims, No Drawings

MULTILAYERED TONER PARTICLE HAVING A BORAX COUPLING AGENT AND METHOD OF PREPARING THE SAME

CROSS REFERENCES TO RELATED APPLICATIONS

This patent application is a continuation application of U.S. patent application Ser. No. 15/941,203, filed Mar. 3, 2018, entitled "Multilayered Toner Particle having a Borax Coupling Agent and Method of Preparing the Same," the content of which is hereby incorporated by reference in its entirety.

BACKGROUND

Field of the Disclosure

The present invention relates generally to chemically prepared toners for use in electrophotography and more particularly to a chemically prepared multilayered toner particle having a borax coupling agent and method for preparing the same.

Description of the Related Art

Toners for use in electrophotographic printers include two primary types, mechanically milled toners and chemically prepared toners (CPT). Chemically prepared toners have significant advantages over mechanically milled toners including better print quality, higher toner transfer efficiency and lower torque properties for various components of the electrophotographic printer such as a developer roller, a fuser belt and a charge roller. The particle size distribution of CPTs is typically narrower than the particle size distribution of mechanically milled toners. The size and shape of CPTs are also easier to control than mechanically milled toners.

One process for preparing a CPT is by emulsion aggregation. Emulsion aggregation is a process carried out in an aqueous system resulting in good control of both the size and shape of the toner particles. The toner components typically include a amorphous polyester resin, one or more colorants and a release agent. The disclosed multilayered toner particle having a borax coupling agent is prepared using an emulsion aggregation process.

One important characteristic of any toner is its fuse window. The fuse window is the range of temperatures at which fusing is satisfactorily conducted without incomplete fusion and without transfer of toner to the heating element, which may be a roller, belt or other member contacting the toner during fusing. Thus, below the low end of the fuse window the toner is incompletely melted and above the high end of the fuse window the toner flows onto the fixing member where it mars subsequent sheets being fixed. It is preferred that the low end of the fuse window be as low as possible to reduce the required temperature of the fuser in the electrophotographic printer to therefore improve the printer's safety and to conserve energy.

In addition to fuse at an energy saving low temperature, the toner must also be able to survive the temperature and humidity extremes associated with storage and shipping—commonly called the ship/store test. Caking or blocking of the toner during shipping and storage usually results in print flaws. Energy saving low fusing toner is desirable but the low end of the fuse window cannot be so low that the toner melts during the storing or shipping of a toner cartridge containing the toner. A low melt and low energy fusing toner must be robust enough to endure shipping and storage conditions in order to be attractive in a worldwide market.

Toners formed from polyester binder resins typically possess better mechanical properties than toners formed from a styrene-acrylic amorphous polyester resin of similar melt viscosity characteristics. Polyester toners also have better compatibility with color pigments resulting in a wider color gamut. However, while polyester toners produced through emulsion aggregation possess excellent fusibility, issues related to the migration of lower molecular weight resins, waxes and colorants persist. The migration of these ingredients to the surface of the toner particle weakens the toner's fusing, toner color covering power and ship/store properties. Hence, an emulsion aggregation toner formulation and process that reduces the migration of lower molecular weight resins, waxes and colorants to the toner particle surface is desired.

The disclosed toner having a multilayered structure results in the above-enumerated desirable properties. Having a toner with a multilayered structure allows for tighter control of the locations of toner components within the toner particle, thereby efficiently controlling properties such as fusing and ship/store. Furthermore, this multilayered structure ensures that the low molecular weight resins, waxes and colorants are completely covered within the center of the toner particle.

SUMMARY

A method for producing an emulsion aggregation multilayered toner for electrophotography, according to an embodiment, includes preparing a first polymer emulsion, a second polymer emulsion, a third polymer emulsion, a pigment dispersion, and a wax emulsion. The second polymer emulsion is divided into a first portion and a second portion. The first polymer emulsion is combined and agglomerated with the pigment dispersion, the wax emulsion, and the first portion of the second polymer emulsion to form toner cores. The second portion of the second polymer emulsion is combined and agglomerated with the toner cores to form a first layer surrounding the toner cores. In another embodiment, the entire portion of the second polymer emulsion is used to form the first layer. Once the toner cores with additional first layer reach a predetermined size, a borax coupling agent is added in the emulsion aggregation process. The third polymer emulsion is then combined and agglomerated with the toner cores having the first layer surrounding the toner core to form a second layer that surrounds or is formed on the surface of the above described first layer. By employing the emulsion aggregation process, the borax coupling agent is between the first and second layers. The second layer also acts as an outermost shell that surrounds the entire toner particle. The aggregated toner cores, first layer, borax coupling agent and second layer/shell are then fused to form multilayered toner particles.

A method for producing an emulsion aggregation multilayered toner for electrophotography according to another embodiment includes preparing a first polymer emulsion, a second polymer emulsion, a third polymer emulsion, a pigment dispersion, and a wax emulsion. The first polymer emulsion is combined and agglomerated with the pigment dispersion, the wax emulsion to form toner cores. The second polymer emulsion is combined and agglomerated with the toner cores to form a first layer surrounding the toner cores. Once the toner cores with additional first layer reach a predetermined size, a borax coupling agent is added to the in process emulsion. The third polymer emulsion is then combined and agglomerated with the toner cores having the first layer surrounding the toner core to form a second layer that surrounds or is formed on the surface of the above described first layer. By employing the emulsion aggregation process, the borax coupling agent is between the first and second layers. The second layer also acts as an outermost shell that surrounds the entire toner particle. The aggregated toner cores, first layer, borax coupling agent and second layer/shell are then fused to form multilayered toner particles.

A chemically prepared multilayered toner composition, according to one example embodiment, includes a core having a first amorphous polyester resin, a second amorphous polyester resin, a colorant, and a release agent. A first layer is formed around the core wherein the first layer includes the same second amorphous polyester resin that is in the toner core. A second layer is formed on the surface of the first layer, wherein the second layer includes a third amorphous polyester resin. A borax coupling agent is between the first and second layers. In an embodiment the ratio of the second polymer in the core to second polymer in the first layer is about 50:50. The second layer can also be referred to as a shell that is formed over the toner particle having a center core, first layer and borax coupling agent. In another embodiment, the core does not contain a second amorphous polyester resin.

A chemically prepared multilayered toner composition, according to another embodiment includes a core including a first amorphous polyester resin, a colorant, and a release agent. A first layer is formed around the core wherein the first layer includes a second amorphous polyester resin. A second layer is formed on the surface of the first layer, wherein the second layer includes a third amorphous polyester resin. A borax coupling agent is between the first and second layers. The second layer can also be referred to as a shell that is formed over the toner particle having a center core, first layer and borax coupling agent.

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

The present disclosure relates to a chemically prepared multilayered toner and the associated emulsion aggregation method used in the preparation of the toner. The multilayered structure allows for a more efficient distribution of the toner components, such as wax domains and pigment, thereby improving the fusing and ship/store properties of the toner.

The toner is utilized in an electrophotographic printer such as a printer, copier, multi-function device or an all-in-one device. The toner may be provided in a cartridge that supplies toner to the electrophotographic printer. Example methods of forming toner using emulsion aggregation techniques are found in U.S. Pat. Nos. 6,531,254 and 6,531,256, which are incorporated by reference herein in their entirety. Additionally, U.S. Pat. Nos. 8,669,035, 9,023,569, 9,612,545 and 9,671,709 disclose example toner formulations and methods of making toner using a borax coupling agent and are assigned to the applicants of the present invention and are incorporated by reference herein in their entirety.

In the present emulsion aggregation process, the toner particles are manufactured by chemical methods as opposed to physical methods such as pulverization. Generally, the multilayered toner includes one or more amorphous polyester resins, a release agent or wax, a colorant, a borax coupling agent and one or more optional additives such as a charge control agent (CCA). In an embodiment, three different polymer latexes are used. The first polymer latex has a low glass transition temperature ('Tg'), a low melting temperature ('Tm'), and a low molecular weight. The second polymer latex has a medium Tg, a medium Tm and a medium molecular weight. This second polymer latex can be divided into portions. In an embodiment, the second polymer latex is divided into a first portion and a second portion, wherein the first portion and second portion are approximately equal, thereby having a ratio of about 50:50. The third polymer latex has a high Tg, a high Tm and a high molecular weight. Using an emulsion aggregation method, the first polymer latex, the pigment, the wax and the first portion of the second polymer latex are agglomerated together to form the center core of the multilayered toner particle. The second portion of the second polymer latex is added and agglomerated around the core of the toner particle to form the first layer surrounding the core of the toner particle. A borax coupling agent is then added during the emulsion aggregation process and aggregated around the first layer surrounding the toner particle. In the next step of the emulsion aggregation process, a third polymer latex having a high Tg, a high Tm and a high molecular weight is added and aggregated to form a second and final shell layer around the toner core and the first layer. The aggregated toner cores, first layer and second layer/shell are then fused to form multilayered toner particles.

In another embodiment, the second polymer latex is not divided into portions. Accordingly, the entire amount of the second polymer latex is added and agglomerated around the core of the toner particle to form the first layer surrounding the core of the toner particle. Using an emulsion aggregation method, the first polymer latex, the pigment, the wax are agglomerated together to form the center core of the multilayered toner particle. The second polymer latex is added and agglomerated around the core of the toner particle to form the first layer surrounding the core of the toner particle. A borax coupling agent is then added during the emulsion aggregation process and aggregated around the first layer surrounding the toner particle. In the next step of the emulsion aggregation process, a third polymer latex having a high Tg, a high Tm and a high molecular weight is added and aggregated to form a second and final shell layer around the toner core and the first layer. The aggregated toner cores, first layer and second layer/shell are then fused to form multilayered toner particles.

A detailed synthesis of the multilayered toner of the present invention is set forth as follows: Emulsions of the first, second and third amorphous polyester resins having the above-described desired Tg(s), Tm(s), and molecular weight(s) are formed in water, optionally with organic solvent, with an inorganic base such as sodium hydroxide, potassium hydroxide, ammonium hydroxide, or an organic amine compound. A stabilizing agent having an anionic functional group (A−), e.g., an anionic surfactant or an anionic polymeric dispersant may also be included. It will be appreciated that a cationic (C+) functional group, e.g., a cationic surfactant or a cationic polymeric dispersant, may be substituted as desired.

The first, second and third polymer latexes, colorant, release agent and the optional CCA are dispersed separately in their own aqueous environments or in one aqueous mixture, as desired, in the presence of a stabilizing agent having similar functionality (and ionic charge) as the stabilizing agent employed in the polymer latexes. The optional CCA may be dispersed separately in the second and outermost layer of the toner particles, if necessary.

The first polymer latex, a first portion of the second polymer latex, the colorant dispersion, and the release agent dispersion are then mixed and stirred to ensure a homogenous composition. As used herein, the term dispersion refers to a system in which particles are dispersed in a continuous phase of a different composition (or state) and may include an emulsion. Acid is then added to reduce the pH and cause flocculation. In this case, flocculation includes the formation of a gel where resin, colorant, release agent and CCA form an aggregate mixture, typically from particles 1-2 microns (μm) in size. Unless stated otherwise, reference to particle size herein refers to the largest cross-sectional dimension of the particle. The aggregated toner particles may then be heated to a temperature that is less than or around (e.g., ±5° C.) the glass transition temperature (Tg) of the polymer latex to induce the growth of clusters of the aggregate particles. Once the aggregate particles reach the desired size of the toner core, the second portion of the second polymer latex is added to form a first layer surrounding the outer surface of the toner core. The reaction temperature is maintained until the particles reached a desired size. A borax coupling agent is added so that it forms on the outer surface of the first layer, composed of the second portion of the second polymer latex. Following addition of the borax coupling agent, the third polymer latex is then added. This third polymer latex aggregates around the toner particle having the toner core/first layer/borax coupling agent structure to form the second and outermost shell layer, wherein the multilayered toner particle is formed. Once the aggregate particles reach the desired toner size, base may be added to increase the pH and reionize the anionic stabilizing agent to prevent further particle growth or one can add additional anionic stabilizing agents. The temperature is then raised above the glass transition temperature of the polymer latexes to fuse the particles together within each cluster. This temperature is maintained until the particles reach the desired circularity.

The multilayered toner particles produced have an average particle size of between about 3 μm and about 20 μm (number average particle size) including all values and increments therebetween, such as between about 4 μm and about 9 μm or, more particularly, between about 5 μm and about 7 μm. The multilayered toner particles produced have an average degree of circularity between about 0.90 and about 1.00, including all values and increments therebetween, such as about 0.93 to about 0.98. The average degree of circularity and average particle size may be determined by a Sysmex Flow Particle Image Analyzer (e.g., FPIA-3000) available from Malvern Instruments, Ltd., Malvern, Worcestershire, UK.

The ratio of the polymers (also referred to as amorphous polyester resins) forming the core and the first and second layer may be varied. The ratio of the polymers in the core:polymer in first layer:polymer in second layer can range from 18:47:36 to (18+23.5): 23.5:35 (wt). In an example embodiment, the entire amount of low Tg/low Tm first polymer is added to the core, along with the pigment and wax and a first portion of the medium Tg/medium Tm second polymer. The second portion of the medium Tg/medium Tm second polymer is used to form the first layer surrounding the core of the toner particle. In an embodiment, the first and second portions of the second polymer are approximately equal, having a ratio of 50:50. In another embodiment, the entire amount of the medium Tg/medium Tm second polymer is used to form the first layer. The high Tg/high Tm third polymer is added last to form the second layer or outermost shell layer. In an embodiment, the high Tg/high Tm third polymer may be between about 20% to about 35% by weight of the total amount of polymers used in the multilayered toner formulation. The first portion of the medium Tg/medium Tm second polymer in the core can be from 0% to 50% of the total second polymer used in the toner formulation.

Through this multilayered structure, the position of the components of the toner, such as the wax, pigment and low molecular weight first polymer may be specifically controlled in specific location, thereby efficiently controlling toner properties such as fusing, charging, ship/store, and variations of color difference. More specifically, having the first polymer (which is used to promote desirable low temperature fusing but unfortunately deteriorates the ship/store), the pigment and the wax (which may affect the toner color covering power, charging, filming and fusing properties of the toner) found in the core of the toner to be completely covered by a first layer and a second shell layer improves the color, ship/store and low temperature fusing properties of the toner.

The various components needed to prepare the above referenced toner via the emulsion aggregation method will be described below. It should be noted that the various features of the indicated components may all be adjusted to facilitate the step of aggregation and formation of toner particles of desired size and geometry. It may therefore be appreciated that by controlling the indicated characteristics, one may first form relatively stable dispersions, wherein aggregation may proceed along with relatively easy control of final toner particle size for use in an electrophotographic printer or printer cartridge.

Amorphous Polyester Resin

As mentioned above, the toners herein include one or more amorphous polyester resins. The terms resin and polymer are used interchangeably herein as there is no technical difference between the two. In one embodiment, the amorphous polyester resin(s) include polyesters.

The polyester binder(s) may include a semi-crystalline polyester binder, a crystalline polyester binder or an amorphous polyester binder. Alternatively, the polyester binder(s) may include a amorphous polyester resin. For example, the polyester binder(s) may include a styrene/acrylic-polyester graft copolymer. The polyester binder(s) may be formed using acid monomers such as terephthalic acid, trimellitic anhydride, dodecenyl succinic anhydride, sebacic acid, and fumaric acid. Further, the polyester binder(s) may be formed using alcohol monomers such as ethoxylated and propoxylated bisphenol A, 1,6-hecanediol, 1,8-octanediol, 1,10-decanediol and 1,12-dodecanediol. Example polyester resins include, but are not limited to, T100, TF-104, NE-1582, NE-701, NE-2141, NE-1569, Binder C, FPESL-2, W-85N, TL-17, TPESL-10, TPESL-11, EPC-720, EPC-820, EPC-920, EPC-1020 polyester resins from Kao Corporation, Bunka Sumida-ku, Tokyo, Japan, or mixtures thereof.

In other embodiments, the amorphous polyester resin(s) also includes a thermoplastic type polymer having the necessary functional groups to participate in the hydrogen bonding. Illustrative thermoplastic type polymer having the necessary functional groups include a styrene and/or substituted styrene polymer, such as a hydroxy-terminated homopolymer (e.g., polystyrene) and/or copolymer (e.g., styrene-butadiene copolymer and/or styrene-acrylic copolymer), a styrene-butyl (meth)acrylate copolymer and/or polymers containing hydroxyl, carboxy functional monomers such as hydroxy-ethyl (meth)acrylate, 2-carboxy-ethyl (meth)acrylate, polyvinyl acetate, polyalkenes, poly(vinyl chloride), polyurethanes, polyamides, silicones, epoxy resins, or phenolic resins.

In other embodiments, the amorphous polyester resin(s) include a polyester and styrene-acrylate copolymers containing monomers mentioned above in the polyester and styrene-acrylate binder section. Examples include but not limited to STPL-1, STPL-8, HB580, HB688 from Kao Corporation, Bunka Sumida-Ku, Tokyo, Japan.

In the present invention, the toner contains three different types of polyester resins used as the amorphous polyester resin in the multilayered toner. In an embodiment, the first, second and third polyester resins are amorphous. In an embodiment, the amorphous polyester resins used in the core of the toner may be linear or slightly crosslinked. The three different amorphous polyester resins may have a Tg of between about 35° C. and about 70° C., and a Tm of between about 50° C. and about 150° C. Specifically, the first low Tg/Tm amorphous polyester resin used in the core has a Tg of between about 40° C. and about 55° C. and a Tm of about 60° C. and about 100° C. The medium Tg/Tm second amorphous polyester resin used both in the core and/or in the first layer has a Tg of between about 55° C. and about 60° C. and a Tm of about 100° C. and about 120° C. The high Tg/Tm third amorphous polyester resin used in the outermost second shell layer has a Tg of between about 60° C. and about 65° C. and a Tm of about 110° C. and about 140° C.

Reversible Borax Coupling Agent

The coupling agent used herein is borax (also known as sodium borate, sodium tetraborate, or disodium tetraborate). As used herein, the term borax coupling agent refers to a chemical compound having the complexing ability to form hydrogen bonding between polymers to bind more components together. As used herein, the term borax coupling agent is defined as enabling the formation of hydrogen bonding between polymer chains. The present multilayered toner particle has a center core surrounded by a first layer and an outermost second or shell layer. The borax coupling agent is placed between the first and second layers. This borax coupling agent assists in the anchoring or binding of the third polymer, which is found in the second or outermost shell layer, onto the surface of the first layer containing the second polymer which is surrounding the toner core. The borax coupling agent thereby helps to couple the outershell/second layer to the outer surface of the first layer surrounding the toner core. Typically, coupling agents have multivalent bonding ability. Borax differs from commonly used permanent coupling agents, such as multivalent metal ions (e.g., aluminum and zinc), in that its bonding is reversible based on the temperature and pressure. In the electrophotographic process, toner is preferred to have a low fusing temperature to save energy and a low melt viscosity ("soft") to permit high speed printing at low fusing temperatures. However, in order to maintain the stability of the toner during shipping and storage and to prevent filming of the printer components, toner is preferred to be "harder" at temperatures below the fusing temperature. Borax provides cross-linking through hydrogen bonding between its hydroxyl groups and the functional groups found in the polymers that it is bonded thereto. The hydrogen bonding is sensitive to temperature and pressure and is not a stable and permanent bond. For example, when the temperature is increased to a certain degree, or stress is applied to the polymer, the bond will partially or completely break causing the polymer to "flow" or tear off. The reversibility of the bonds formed by the borax coupling agent is particularly useful in toner because it permits a "soft" toner at the fusing temperature but a "hard" toner at the storage temperature.

The quantity of the borax coupling agent used herein can be varied. The borax coupling agent may be provided at between about 0.1% and about 0.5% by weight of the total amorphous polyester resin in the toner, including all values and increments between, such as between 0.1% and about 1.0% or between 0.1% and about 0.5%. If too much coupling agent is used, its bonding may not be completely broken during high temperature fusing and will affect the agglomeration and particle size. On the other hand, if too little coupling agent is used, it may fail to provide the desired bonding and buffering effects.

Colorant

Colorants are compositions that impart color or other visual effects to the toner and may include carbon black, dyes (which may be soluble in a given medium and capable of precipitation), pigments (which may be insoluble in a given medium) or a combination of the two. A colorant dispersion may be prepared by mixing the pigment in water with a dispersant. Alternatively, a self-dispersing colorant may be used thereby permitting omission of the dispersant. The colorant may be present in the dispersion at a level of about 5% to about 40% by weight including all values and increments therebetween. For example, the colorant may be present in the dispersion at a level of about 10% to about 15% by weight. The dispersion of colorant may contain particles at a size of about 50 nanometers (nm) to about 500 nm including all values and increments therebetween. Further, the colorant dispersion may have a pigment weight percent divided by dispersant weight percent (P/D ratio) of about 1:1 to about 8:1 including all values and increments therebetween, such as about 2:1 to about 5:1. The colorant may be present at less than or equal to about 15% by weight of the final toner formulation including all values and increments therebetween.

Release Agent

The release agent used may include any compound that facilitates the release of toner from a component in an electrophotographic printer (e.g., release from a roller surface). For example, the release agent or wax may include polyolefin wax, Fischer-Tropsch wax, ester wax, polyester wax, polyethylene wax, metal salts of fatty acids, fatty acid esters, partially saponified fatty acid esters, higher fatty acid esters, higher alcohols, paraffin wax, carnauba wax, amide waxes and polyhydric alcohol esters or mixtures thereof.

The wax or release agent may therefore include a low molecular weight hydrocarbon based polymer (e.g., Mn≤10,000) having a melting point of less than about 140° C.

including all values and increments between about 50° C. and about 140° C. The wax may be present in the dispersion at an amount of about 5% to about 35% by weight including all values and increments there between. For example, the wax may be present in the dispersion at an amount of about 10% to about 18% by weight. The wax dispersion may also contain particles at a size of about 50 nm to about 1 μm including all values and increments there between. In addition, the wax dispersion may be further characterized as having a wax weight percent divided by dispersant weight percent (RA/D ratio) of about 1:1 to about 30:1. For example, the RA/D ratio may be about 3:1 to about 8:1. The wax is provided in the range of about 2% to about 40% by weight of the final toner formulation including all values and increments there between. Exemplary waxes having these above enumerated characteristics include, but are not limited to, SD-A01, SD-B01, MPA-A02, CM-A01 and CM-B01 from Cytech Products, Inc., Polywax M70, Polywax M80 and Polywax 500 from Baker Petrolite and WE5 from Nippon Oil and Fat.

Surfactant/Dispersant

A surfactant, a polymeric dispersant or a combination thereof may be used. The polymeric dispersant may generally include three components, namely, a hydrophilic component, a hydrophobic component and a protective colloid component. Reference to hydrophobic refers to a relatively non-polar type chemical structure that tends to self-associate in the presence of water. The hydrophobic component of the polymeric dispersant may include electron-rich functional groups or long chain hydrocarbons. Such functional groups are known to exhibit strong interaction and/or adsorption properties with respect to particle surfaces such as the colorant and the polyester binder resin of the polyester resin emulsion. Hydrophilic functionality refers to relatively polar functionality (e.g., an anionic group) which may then tend to associate with water molecules. The protective colloid component includes a water soluble group with no ionic function. The protective colloid component of the polymeric dispersant provides extra stability in addition to the hydrophilic component in an aqueous system. Use of the protective colloid component substantially reduces the amount of the ionic monomer segment or the hydrophilic component in the polymeric dispersant. Further, the protective colloid component stabilizes the polymeric dispersant in lower acidic media. The protective colloid component generally includes polyethylene glycol (PEG) groups. The dispersant employed herein may include the dispersants disclosed in U.S. Pat. Nos. 6,991,884 and 5,714,538, which are assigned to the assignee of the present application and are incorporated by reference herein in their entirety.

The surfactant, as used herein, may be a conventional surfactant known in the art for dispersing non self-dispersing colorants and release agents employed for preparing toner formulations for electrophotography. Commercial surfactants such as the AKYPO series of carboxylic acids from AKYPO from Kao Corporation, Bunka Sumida-ku, Tokyo, Japan may be used. For example, alkyl ether carboxylates and alkyl ether sulfates, preferably lauryl ether carboxylates and lauryl ether sulfates, respectively, may be used. One particular suitable anionic surfactant is AKYPO RLM-100 available from Kao Corporation, Bunka Sumida-ku, Tokyo, Japan, which is laureth-11 carboxylic acid thereby providing anionic carboxylate functionality. Other anionic surfactants contemplated herein include alkyl phosphates, alkyl sulfonates and alkyl benzene sulfonates. Sulfonic acid containing polymers or surfactants may also be employed.

Optional Additives

The toner formulation of the present disclosure may also include one or more conventional charge control agents, which may optionally be used for preparing the toner formulation. A charge control agent may be understood as a compound that assists in the production and stability of a tribocharge in the toner. The charge control agent(s) also help in preventing deterioration of charge properties of the toner formulation. The charge control agent(s) may be prepared in the form of a dispersion in a manner similar to that of the colorant and release agent dispersions discussed above.

The toner formulation may include one or more additional additives, such as acids and/or bases, emulsifiers, extra particular additives, UV absorbers, fluorescent additives, pearlescent additives, plasticizers and combinations thereof. These additives may be desired to enhance the properties of an image printed using the present toner formulation. For example, UV absorbers may be included to increase UV light fade resistance by preventing gradual fading of the image upon subsequent exposures to ultraviolet radiations. Suitable examples of the UV absorbers include, but are not limited to, benzophenone, benzotriazole, acetanilide, triazine and derivatives thereof.

The following examples are provided to further illustrate the teachings of the present disclosure, not to limit the scope of the present disclosure.

Example Polyester Resin Emulsions

Preparation of Example Polyester Resin Emulsion A Having a Medium Tg and Medium Tm (Polyester Resin Emulsion A')

A polyester resin having a peak molecular weight of about 11,000, a glass transition temperature (Tg) of about 55° C. to about 58° C., a melt temperature (Tm) of about 115° C., and an acid value of about 8 to about 13 was used. The glass transition temperature is measured by differential scanning calorimetry (DSC), wherein, in this case, the onset of the shift in baseline (heat capacity) thereby indicates that the Tg may occur at about 55° C. to about 58° C. at a heating rate of about 5° C. per minute. The acid value may be due to the presence of one or more free carboxylic acid functionalities (—COOH) in the polyester. Acid value refers to the mass of potassium hydroxide (KOH) in milligrams that is required to neutralize one gram of the polyester. The acid value is therefore a measure of the amount of carboxylic acid groups in the polyester.

150 g of the polyester resin was dissolved in 450 g of methyl ethyl ketone (MEK) in a round bottom flask with stirring. The dissolved resin was then poured into a beaker. The beaker was placed in an ice bath directly under a homogenizer. The homogenizer was turned on at high shear and 3.7 g of 10% potassium hydroxide (KOH) solution and 500 g of de-ionized water were immediately added to the beaker. The homogenizer was run at high shear for about 2-4 minutes then the homogenized resin solution was placed in a vacuum distillation reactor. The reactor temperature was maintained at about 43° C. and the pressure was maintained between about 22 inHg and about 23 inHg. About 500 mL of additional de-ionized water was added to the reactor and the temperature was gradually increased to about 70° C. to ensure that substantially all of the MEK was distilled out. The heat to the reactor was then turned off and the mixture was stirred until it reached room temperature. Once the reactor reached room temperature, the vacuum was turned off and the resin solution was removed and placed in storage bottles.

The particle size of Polyester Resin Emulsion A was between about 190 nm and about 240 nm (volume average)

as measured by a Nanotrac Particle Size Analyzer. The pH of the resin solution was between about 7.5 and about 8.2.

Preparation of Example Polyester Resin Emulsion B Having a Low Tg and a Low Tm (Polyester Resin Emulsion B')

A polyester resin having a peak molecular weight of about 6500, a glass transition temperature of about 49° C. to about 54° C., a melt temperature of about 95° C., and an acid value of about 21 to about 24 was used to form an emulsion using the procedure outlined making Polyester Resin Emulsion A except using about 12.8 g of the 10% potassium hydroxide (KOH) solution.

The particle size of Polyester Resin Emulsion B was between about 160 nm and about 220 nm (volume average) as measured by a Nanotrac Particle Size Analyzer. The pH of the resin solution was between about 6.3 and about 6.8.

Preparation of Example Polyester Resin Emulsion C Having a High Tg and a High Tm (Polyester Resin Emulsion C')

A polyester resin having a peak molecular weight of about 13000, a glass transition temperature of about 58° C. to about 62° C., a melt temperature of about 114° C. and an acid value of about 19 to 20 was used to form an emulsion using the procedure outlined making Polyester Resin Emulsion A except using about 10.1 g of the 10% potassium hydroxide (KOH) solution.

The particle size of Polyester Resin Emulsion C was between about 100 nm and about 300 nm (volume average) as measured by a Nanotrac Particle Size Analyzer. The pH of the resin solution was between about 6.8 and about 8.5.

Preparation of Example Cyan Pigment Dispersion

About 10 g of AKYPO RLM-100 polyoxyethylene(10) lauryl ether carboxylic acid from Kao Corporation, Bunka Sumida-ku, Tokyo, Japan was combined with about 350 g of de-ionized water and the pH was adjusted to ~7-9 using sodium hydroxide. About 10 g of Solsperse 27000 from Lubrizol Advanced Materials, Cleveland, Ohio, USA was added and the dispersant and water mixture was blended with an electrical stirrer followed by the relatively slow addition of 100 g of pigment blue 15:3. Once the pigment was completely wetted and dispersed, the mixture was added to a horizontal media mill to reduce the particle size. The solution was processed in the media mill until the particle size was about 200 nm. The final pigment dispersion was set to contain about 20% to about 40% solids by weight.

Preparation of Example Wax Emulsion

About 12 g of AKYPO RLM-100 polyoxyethylene(10) lauryl ether carboxylic acid from Kao Corporation, Bunka Sumida-ku, Tokyo, Japan was combined with about 325 g of de-ionized water and the pH was adjusted to ~7-9 using sodium hydroxide. The mixture was then processed through a microfluidizer and heated to about 90° C. About 12 g of ester wax and 48 g of paraffin wax from Cytec Products Inc., Elizabethtown, Ky. was added to the hot mixture while the temperature was maintained at about 90° C. for about 15 minutes. The emulsion was then removed from the microfluidizer when the particle size was below about 250 nm. The solution was then stirred at room temperature. The wax emulsion was set to contain about 15% to about 25% solids by weight.

Toner Formulation Examples

Example Multilayered Toner 1

Components were added to a 2 L reactor in the following percentages based on total solids of the emulsions (excluding dispersant amounts): about 195 g of 29.76% Polyester Resin Emulsion A, 152 g of 29.75% Polyester Resin Emulsion B, 58.3 of Cyan Pigment Dispersion with 30.3% solids and 5:1 P:D ratio, 102.2 g of 34% Wax Emulsion with W:D ratio of about 28.5:1 (Cytech Products, Inc.), and 834 g of deionized water.

The core raw materials were stirred in the reactor at about 25° C. and a circulation loop was started consisting of a high shear mixer and an acid addition pump. The mixture was sent through the loop, with the high shear mixer set at 10,000 RPM. Acid was slowly added to the slurry passing through the high shear mixer in order to evenly disperse the acid throughout the toner mixture so that there were no pockets with a low pH. Acid addition took about four minutes with 205 g sulfuric acid. The sulfuric acid used during this step was diluted to 1% concentration before addition. The flow of the loop was then reversed to return the toner mixture to the reactor and the temperature of the reactor was increased to about 38° C. Once the particle size reached 3.5-4.0 μm (number average), 195 g of 29.76% Polyester Resin Emulsion A was added to the reactor to form the second layer around the core. Once the reaction temperature reached 42° C. and the particle sized reached about 4.0-4.5 μm (number average), 29 g of 5% borax solution was added. After the addition of borax, 290 g of 29.68% Polyester Resin Emulsion C was added. The mixture was stirred for about 5 minutes and the pH was monitored. The mixture was then slowly heated to about 50° C. Once the particle size reached 5-5.5 μm (number average), 4% NaOH was added in order to raise the pH to about 6.5 and stop particle growth. The temperature was then increased to 83° C. to cause the particles to coalesce. The temperature was maintained until the particles reached the desired circularity (above 0.97, measured on a Sysmex FPIA-3000 from Malvern). The toner was then washed and dried. Finishing agents were added so that the toner could be printed. The toner had a number average particle size 5.2 μm. Fines (<2 μm) were present at 0.85% (by number) and the toner possessed a circularity of 0.97. The ship/store score registered 48 at 52° C.

Multilayered Toner 2

The toner followed the same procedure outlined in Multilayered Toner 1. The resulting toner had a number average particle size 4.7 μm. Fines (<2 μm) were present at 1.39% (by number) and the toner possessed a circularity of 0.97. The ship/store score registered 51 at 52° C.

Multilayered Toner 3

Components were added to a 5 L reactor in the following percentages based on total solids of the emulsions (excluding dispersant amounts): about 319.24 g of 29.75% Polyester Resin Emulsion B, 129.6 of Cyan Pigment Dispersion with 29.17% solids and 5:1 P:D ratio, 209.6 g of 35% Wax Emulsion with W:D ratio of about 28.5:1 (Cytech Products, Inc.), and 2000 g of deionized water.

The core raw materials were stirred in the reactor at about 25° C. and a circulation loop was started consisting of a high shear mixer and an acid addition pump. The mixture was sent through the loop, with the high shear mixer set at 10,000 RPM. Acid was slowly added to the slurry passing through the high shear mixer in order to evenly disperse the acid throughout the toner mixture so that there were no pockets with a low pH. Acid addition took about four minutes with 150 g sulfuric acid. The sulfuric acid used during this step was diluted to 1.92% concentration before addition. The flow of the loop was then reversed to return the toner mixture to the reactor and the temperature of the reactor was increased to about 38° C. Once the particle size reached 3.5-4.0 μm (number average), 833.5 g of 29.75% Polyester Resin Emulsion A was added to the reactor to form the first layer around the core. Once the reaction temperature reached 42° C. and the particle sized reached about 4.0-4.5 μm (number average), 63.2 g of 5% borax solution was added. After the addition of borax, 620.7 g of 29.75% Polyester Resin Emulsion C was added. The mixture was stirred for about 5 minutes and the pH was monitored. The mixture was then slowly heated to about 50° C. Once the particle size reached 5-5.5 μm (number average), 4% NaOH was added in order to raise the pH to about 6.5 and stop particle growth. The temperature was then increased to 83° C. to cause the particles to coalesce. The temperature was maintained until the particles reached the desired circularity (above 0.97, measured on a Sysmex FPIA-3000 from Malvern). The toner was then washed and dried. Finishing agents were added so that the toner could be printed. The toner had a number average particle size 5.1 μm. Fines (<2 μm) were present at 0.27% (by number) and the toner possessed a circularity of 0.98. The ship/store score is 50 at 52° C.

Toner 1

A commercially available core shell low temperature fusing polyester toner was tested and compared to the Multilayered Toner. Toner 1 is Xerox® EA-Eco toner. EA-Eco is produced using an emulsion aggregation process with crystalline polyester.

Control Toner

Components were added to a 5 L reactor in the following percentages based on total solids of the emulsions (excluding dispersant amounts): about 833.5 g of 29.75% Polyester Resin Emulsion A, 319.24 g of 29.75% Polyester Resin Emulsion B, 129.6 of Cyan Pigment Dispersion with 29.17% solids and 5:1 P:D ratio, 209.6 g of 35% Wax Emulsion with W:D ratio of about 28.5:1 (Cytech Products, Inc.), and 2000 g of deionized water.

The mixture was heated in the reactor to 25° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 5 minutes with 210 g of 1.92% sulfuric acid solution. The flow of the loop was then reversed to return the toner mixture to the reactor and the temperature of the reactor was increased to about 37-42° C. Once the particle size reached 5.0 μm (number average), 63 g of 5% (wt.) borax solution was added. After the addition of borax, the Example Polyester Resin Emulsion C 620.7 g of 29.75% was added to form the shell layer. The mixture was stirred for about 5 minutes and the pH was monitored. Once the particle size reached 5-5.5 μm (number average), 4% NaOH was added to raise the pH to about 7.0 to stop the particle growth. The reaction temperature was held for one hour. The particle size was monitored during this time period. Once particle growth stopped, the temperature was increased to 83° C. to cause the particles to coalesce. This temperature was maintained until the particles reached their desired circularity (about 0.97). The toner was then washed and dried. Finishing agents were added so that the toner could be printed.

The dried toner had a number average particle size of 5.42 μm. Fines (<2 μm) were present at 0.5% (by number) and the toner possessed a circularity of 0.97. The ship/store test score is 54 at 52° C.

Test Results

A toner's fusing properties include its fuse window. The fuse window is the range of temperatures at which fusing is satisfactorily conducted without incomplete fusion and without transfer of toner to the heating element, which may be a roller, belt or other member contacting the toner during fusing. Thus, below the low end of the fuse window the toner is incompletely melted and above the high end of the fuse window the toner flows onto the fixing member where it mars subsequent sheets being fixed. It is preferred that the low end of the fuse window be as low as possible to reduce the required temperature of the fuser in the electrophotographic printer to improve the printer's safety and to conserve energy. Another toner property that is measured is called the Ship to Store property. Toner must be able to survive the temperature and humidity extremes associated with storage and shipping without caking or blocking which may result in print flaws. As a result, the low end of the fuse window cannot be so low that the toner could melt during the storing or shipping of a toner cartridge containing the toner.

Fusing Results

Each toner formulation was printed (but not fused) with toner coverage of 1.1 mg/cm2 on 24# Hammermill laser paper. The unfused sheet was then passed through a fusing robot at 60 ppm with varying heater set point temperatures at 5° C. intervals. One fuse grade measurement is a scratch resistance test. For the scratch resistance test, the fused print samples were evaluated using a Taber Abrader device from TABER Industries, North Tonawanda, N.Y., USA. The printed samples were evaluated on the Taber Abrader scale from 0 to 10 (where a rating of 10 indicates the most scratch resistance). The Taber Abrader device scratches the printed samples multiple times with different forces until the toner is scratched off the sample. The point at which the toner is scratched off corresponds with a number rating between 0 and 10 on the Taber Abrader scale.

Table 1 compares the toner fusing data of the various example toners at a number of fusing temperatures. An acceptable low fusing temperature for a chemically prepared toner is 180°-190° C. or below. Table 1 also shows ship/store data determined at 52° C. for 48 hours. Ship/store results below 60 are acceptable.

Table 1 lists the toner fusing data and ship/store results for the Multilayered Toners 1 and 2, Toner 1 and Control Toner.

TABLE 1

| | Scratch Test Fusing Temp (° C.) | | | | | | | | | | | | |
|---|---|---|---|---|---|---|---|---|---|---|---|---|---|
| | 175 | 180 | 185 | 190 | 195 | 200 | 205 | 210 | 215 | 220 | 225 | 230 | Ship/Store |
| Toner 1 | CO | 2.3333 | 7.6667 | 10 | 10 | 10 | 10 | 10 | 10 | 10 | 10 | 10 | 69 |
| Control Toner | CO | CO | 9 | 10 | 10 | 10 | 10 | 10 | 10 | 10 | 10 | 10 | 56 |
| Multilayered Toner 1 | CO | 7 | 10 | 10 | 10 | 10 | 10 | 10 | 10 | 10 | 10 | 10 | 48 |
| Multilayered Toner 2 | CO | 5.3333 | 8.6667 | 10 | 10 | 10 | 10 | 10 | 10 | 10 | 10 | 10 | 51 |

As shown in Table 1, the Multilayered Toner 1 exhibited superior fusing performance compared to Toner 1 and the Control Toner. The low end of the fusing window for the Multilayer Toner 1 was lower than the low end of the fusing window for Toner 1 which has the crystalline polyester resin and Control Toner. Specifically, the Multilayer Toner 1 provided acceptable scratch resistance at a temperature as low as 185° C. Accordingly, less energy is required to accomplish an acceptable fusing operation for the Multilayer Toner 1 when compared to Toner 1 and the Control Toner. Importantly, the Multilayer Toner 1 also exhibited an acceptable ship/store result while attaining a desirable low fusing temperature of 185° C.

The foregoing description of several embodiments of the present disclosure has been presented for purposes of illustration. It is not intended to be exhaustive or to limit the present disclosure to the precise forms disclosed, and obviously many modifications and variations are possible in light of the above teaching. It is intended that the scope of the present disclosure be defined by the claims appended hereto.

What is claimed is:

1. A chemically prepared multilayered toner composition comprising:

a core having an outer surface, the core having components including a first amorphous polyester resin having functional groups, a second amorphous polyester resin having functional groups, a colorant and a release agent;

a first layer formed around the outer surface of the core, the first layer including the second amorphous polyester resin having functional groups used in the core;

a borax coupling agent located over the first layer;

a second shell layer formed around the core, the first layer and the borax coupling agent, the second shell layer including a third amorphous polyester resin having functional groups, wherein the borax coupling agent is located between the first layer and the second shell layer and bonds the second shell layer to the first layer by forming hydrogen bonding between hydroxyl groups present in the borax coupling agent and the functional groups present in the second amorphous polyester resin found in the first layer and third amorphous polyester resin found in the second shell layer.

2. The chemically prepared multilayered toner composition of claim 1, wherein the first amorphous polyester resin having functional groups has a glass transition temperature (Tg) of between about 40° C. and about 55° C., and a melting temperature (Tm) of between about 60° C. and about 100° C.

3. The chemically prepared multilayered toner composition of claim 1, wherein the second amorphous polyester resin having functional groups has a glass transition temperature (Tg) of between about 55° C. and about 60° C., and a melting temperature (Tm) of between about 100° C. and about 120° C.

4. The chemically prepared multilayered toner composition of claim 1, wherein the third amorphous polyester resin having functional groups has a glass transition temperature (Tg) of between about 60° C. and about 65° C., and a melting temperature (Tm) of between about 110° C. and about 140° C.

* * * * *